US007873464B2

(12) United States Patent
Shartzer et al.

(10) Patent No.: US 7,873,464 B2
(45) Date of Patent: Jan. 18, 2011

(54) BLOCK HEATER USAGE DETECTION AND COOLANT TEMPERATURE ADJUSTMENT

(75) Inventors: Samuel Bryan Shartzer, Greenville, SC (US); Wajdi B. Hamama, Whitmore Lake, MI (US); Roberto De Paula, New Hudson, MI (US); Jaehak Jung, Pittsford, NY (US); Igor Anilovich, Walled Lake, MI (US); John W. Siekkinen, Novi, MI (US)

(73) Assignee: GM Global Technology Operations, Inc.

( * ) Notice: Subject to any disclaimer, the term of this patent is extended or adjusted under 35 U.S.C. 154(b) by 0 days.

(21) Appl. No.: 12/536,708

(22) Filed: Aug. 6, 2009

(65) Prior Publication Data

US 2010/0256892 A1 Oct. 7, 2010

Related U.S. Application Data

(60) Provisional application No. 61/165,718, filed on Apr. 1, 2009.

(51) Int. Cl.
*F02M 7/28* (2006.01)

(52) U.S. Cl. ..... 701/113; 123/435; 123/491

(58) Field of Classification Search ..... 701/103–105, 701/113; 123/435, 491
See application file for complete search history.

(56) References Cited

U.S. PATENT DOCUMENTS

| | | | | |
|---|---|---|---|---|
| 5,605,137 | A * | 2/1997 | Priestly et al. | 123/491 |
| 6,292,741 | B1 * | 9/2001 | Bitzer et al. | 701/115 |
| 7,793,641 | B2 * | 9/2010 | Ma et al. | 123/491 |
| 2009/0178474 | A1 * | 7/2009 | Bailey | 73/114.38 |

* cited by examiner

*Primary Examiner*—Hai H Huynh

(57) ABSTRACT

A control system for an engine includes a block heater determination module, an adjustment module, and an engine control module. The block heater determination module generates a block heater usage signal based on ambient temperature, measured engine coolant temperature, and a length of time of the engine being off prior to engine startup. The adjustment module generates a temperature signal based on the ambient temperature. The engine control module determines a desired fuel mass for fuel injection at engine startup based on the temperature signal when the block heater usage signal has a first state. The engine control module determines the desired fuel mass at engine startup based on the measured engine coolant temperature when the block heater usage signal has a second state.

22 Claims, 7 Drawing Sheets

BLOCK HEATER USAGE DETECTION AND COOLANT TEMPERATURE ADJUSTMENT

CROSS-REFERENCE TO RELATED APPLICATIONS

This application claims the benefit of U.S. Provisional Application No. 61/165,718, filed on Apr. 1, 2009. The disclosure of the above application is incorporated herein by reference in its entirety.

FIELD

The present disclosure relates to internal combustion engines and more particularly to systems and methods to determine use of a block heater and corresponding compensation for engine coolant temperature values.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With reference to FIG. 1, a functional block diagram of an exemplary engine system 100 according to the prior art is shown. An engine 110 includes an intake manifold 112, an intake air temperature (IAT) sensor 116, and an engine coolant temperature (ECT) sensor 118. An engine control module 114 controls the engine 110 based on an IAT signal from the IAT sensor 116 and an ECT signal from the ECT sensor 118.

In cold weather, the driver may apply power to the block heater 122 to warm the engine 110. The block heater 122 is installed in a coolant passage of the engine 110. When the block heater 122 receives power, the coolant in the passage is warmed, which warms the engine 110. Using the block heater 122 in cold temperatures may reduce difficulties in starting the engine 110, such as excessive cranking, stalling, and/or misfiring.

SUMMARY

A control system for an engine includes a block heater determination module, an adjustment module, and an engine control module. The block heater determination module generates a block heater usage signal based on ambient temperature, measured engine coolant temperature, and a length of time of the engine being off prior to engine startup. The adjustment module generates a temperature signal based on the ambient temperature. The engine control module determines a desired fuel mass for fuel injection at engine startup based on the temperature signal when the block heater usage signal has a first state. The engine control module determines the desired fuel mass at engine startup based on the measured engine coolant temperature when the block heater usage signal has a second state.

A method includes generating a block heater usage signal based on ambient temperature, measured engine coolant temperature, and a length of time of an engine being off prior to engine startup; generating a temperature signal based on the ambient temperature; determining a desired fuel mass for fuel injection at engine startup based on the temperature signal when the block heater usage signal has a first state; and determining the desired fuel mass at engine startup based on the measured engine coolant temperature when the block heater usage signal has a second state.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
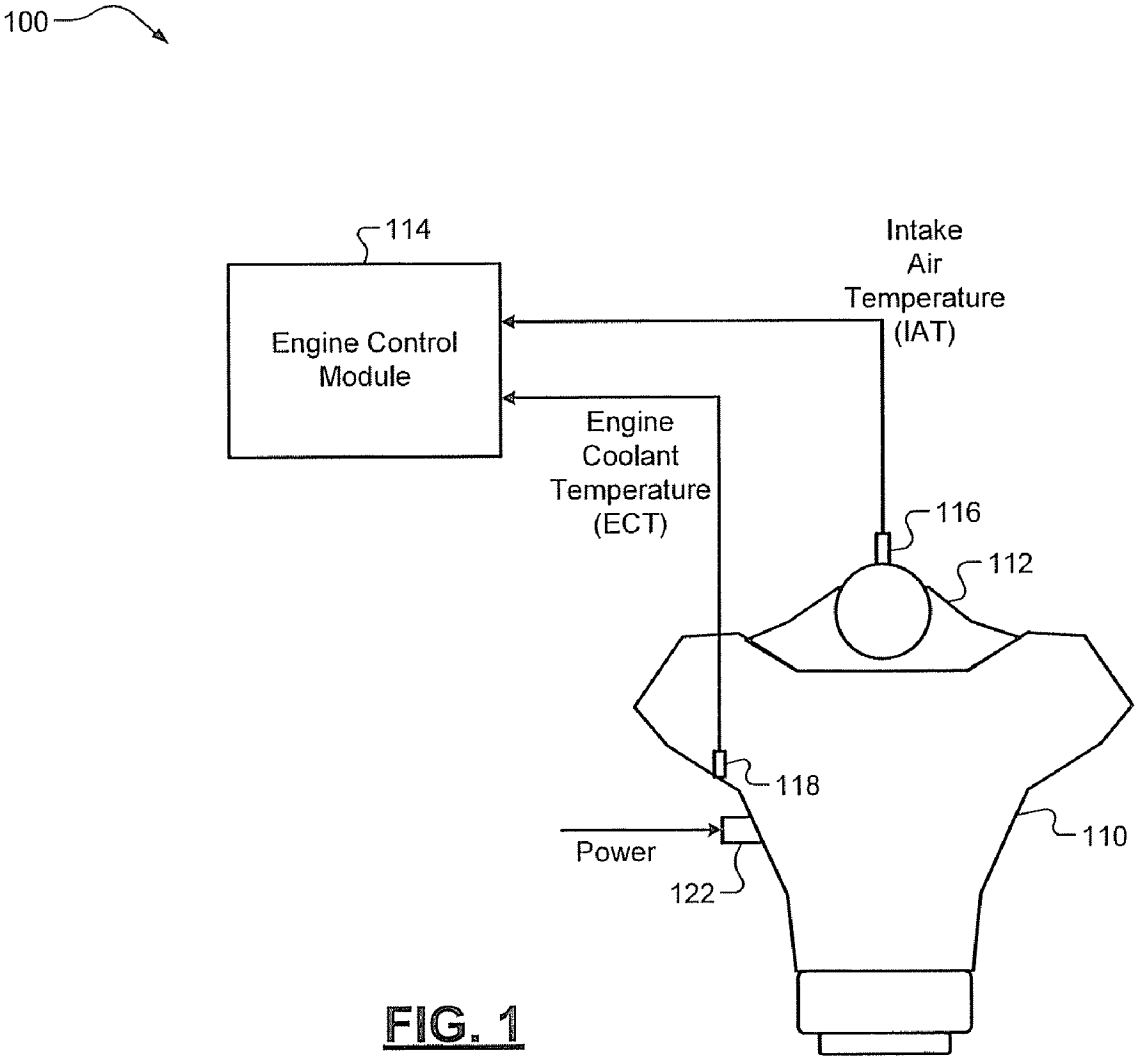
FIG. 1 Prior Art
FIG. 1 is a functional block diagram of an exemplary engine system according to the prior art.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A block heater is used in cold weather to warm engine coolant and engine components when an engine has been off (soaking) for a period of time, such as overnight. Generally, when the engine is off, the engine coolant is not circulating. For example, a crankshaft-driven coolant pump is idle when the engine is off.

Therefore, when the block heater is used, the engine coolant near the block heater may get much hotter than the engine coolant located further from the block heater because the engine coolant is not circulating. Therefore, the engine components are generally also not uniform in temperature when the block heater is used. If an engine coolant temperature (ECT) sensor is located near the block heater, an ECT signal from the ECT sensor may indicate a temperature that is significantly higher than the actual temperature of some of the engine components. Natural convection currents may drive temperatures much higher when the ECT sensor is located above the block heater.

In various implementations, the block heater may be located remotely from some or all of the cylinders of the engine. The ECT signal may therefore be an inaccurate representation of the temperature of the cylinders. Because cylinder temperature affects combustion, an engine control module may determine a desired air/fuel ratio, a desired spark advance, and/or desired fuel injection timing based on engine temperature.

The engine control module may use the ECT signal as an estimation of cylinder temperature. When the ECT signal is not an accurate representation of engine temperature, the air/fuel ratio determined by the engine control module may not be optimal. Non-optimal air/fuel ratios may result in misfire, stalling, excessive engine cranking, or even the engine being unable to start.

Knowing whether the block heater was used may allow the engine control module to evaluate the accuracy of the ECT signal and to apply compensation to the ECT signal. The engine control module may estimate whether the block heater was used based on environmental conditions and operating characteristics of the engine. For example, the engine control module may assume that the block heater was used when an ambient temperature below a threshold temperature are detected.

The engine control module may track usage of the block heater to predict when the block heater will next be used. For example only, the number of times the block heater has been used in various operating conditions may be stored. Based on this historical data, the engine control module can estimate the likelihood of the block heater being used during similar operating conditions.

The operating conditions may include ambient temperature, engine coolant temperature, and engine off time. For example, the engine control module may track the number of engine starts performed within different ranges of ambient temperature and different ranges of engine off times. The engine control module may record how many engine starts occurred for each set of operating conditions, and for how many of those starts the block heater was used. For example only, the engine control module may determine that an operator of the vehicle may be more likely to use the block heater when the ambient temperature is within a certain range and/or when the engine off time is within a certain range.

In various implementations, a temperature model may be employed to estimate engine temperature while the engine is off. If the ECT signal is higher than the estimated temperature by more than a predetermined amount, the engine control module may assume that the difference is the result of block heater usage.

The engine control module may control various engine systems, such as a spark system and/or a fuel injection system, based on engine temperature. When the engine control module determines that the block heater has not been used, the ECT signal may be used as the engine temperature. However, when the engine control module determines that the block heater has been used, a corrected value may be used as the engine temperature.

The corrected value may be calculated by adding an offset to the ECT signal. The offset may be determined based on the difference between the ECT signal and ambient temperature and/or may be based on the modeled engine temperature. Further, if the engine control module uses the ECT signal as the engine temperature, and the engine has difficulty starting, the block heater may in fact have been used. Therefore, if other causes are ruled out, the engine control module may assume that the block heater has been used and switch the engine temperature from the ECT signal to the corrected value.

As the engine starts and runs, the coolant pump will circulate coolant throughout the engine. Over time, the ECT signal will then accurately reflect the temperature of the coolant throughout the engine. Therefore, when the engine control module uses the corrected temperature signal, the offset between the ECT signal and the corrected temperature signal can be reduced. Once the offset is below a threshold, or equal to zero, the engine control module switches to using the ECT signal as the engine temperature. In order to improve future estimation of block heater usage, the engine control module may update block heater usage history based on whether usage of the block heater was detected.

Figure 2:
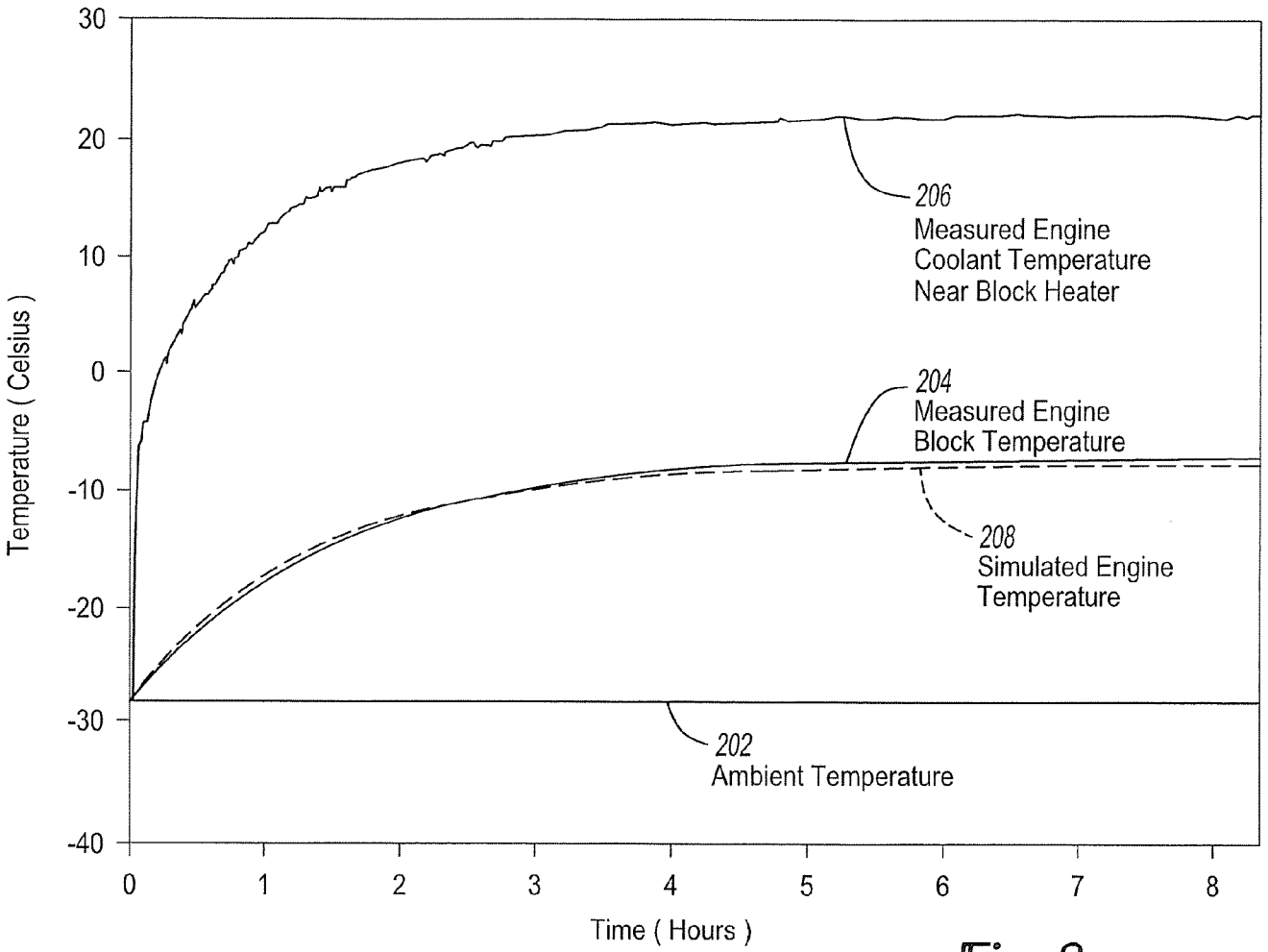
FIG. 2 is a chart depicting exemplary temperatures when an engine block heater is used to warm an engine according to the principles of the present disclosure.

Referring now to FIG. 2, a chart depicts exemplary engine temperatures with respect to time. Ambient temperature is shown at 202, staying constant at approximately −28° C. Measured engine block temperature is shown at 204. The measured engine block temperature 204 may have been obtained from a thermistor installed in the engine block. The thermistor may not be present in production engines, which is why engine coolant temperature is used as an approximation of engine block temperature.

At time 0, measured engine block temperature 204 and ambient temperature 202 are the same, indicating a full soak. A full soak may be defined as the engine being off long enough for the engine block to reach ambient temperature. A partial soak may be defined as an engine being off for less than the amount of time that it takes the engine block to reach ambient temperature.

For purposes of illustration, an engine block heater is turned on at time 0 in FIG. 2. The measured engine block temperature 204 therefore increases beginning at time 0. Measured engine coolant temperature from the engine coolant temperature sensor is shown at 206. When the engine coolant temperature sensor is located near the block heater, the coolant will locally warm in response to the block heater.

In the example of FIG. 2, the measured engine coolant temperature 206 plateaus at approximately 22° C. while the measured engine block temperature 204 plateaus at only approximately −8° C. In this configuration, when the block heater is on, the measured engine coolant temperature 206 is an inaccurate representation of the actual engine block temperature.

If the engine control module uses the measured engine coolant temperature to determine air/fuel ratio, spark timing, and/or fuel injection timing, the engine may have difficulty in starting. For example, additional fuel may be needed at lower temperatures (referred to as cold start enrichment). However, when the measured engine coolant temperature 206 is much greater than the actual measured engine block temperature 204, the engine control module may not perform cold start enrichment. The amount of fuel provided will therefore be less than is appropriate for the actual engine block temperature.

Therefore, the engine control module may determine a more accurate representation of the engine block temperature. When a sensor (such as the thermistor) that directly measures the measured engine block temperature 204 is not present, a simulated engine temperature 208 may be calculated. The simulated engine temperature 208 may be periodically updated while the engine is off. The simulated engine temperature 208 may be based on a first order heat transfer model of the engine.

Because the measured engine coolant temperature 206 increases rapidly beginning at time 0, the engine control module may assume that the block heater has been turned on at time 0. According to the heat transfer model, the block heater introduces heat to the engine, while the lower temperature ambient air removes heat from the engine. In the example of FIG. 2, the simulated engine temperature 208 closely tracks the measured engine block temperature 204.

Figure 3:
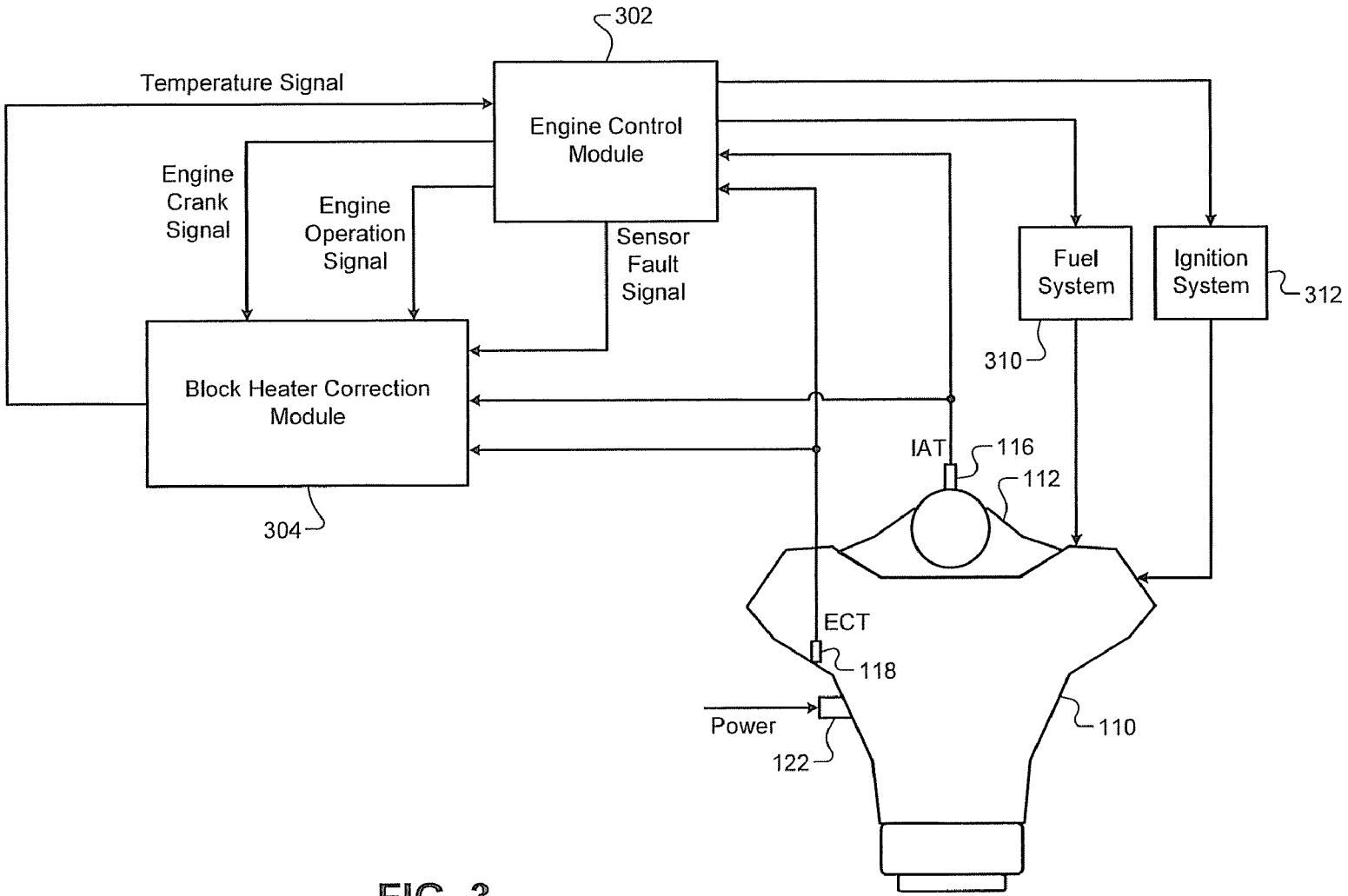
FIG. 3 is a functional block diagram of an exemplary engine system according to the principles of the present disclosure.

Referring now to FIG. 3, an exemplary engine system includes the engine 110 and an engine control module 302. A block heater correction module 304 provides a temperature signal to the engine control module 302. The temperature signal indicates the temperature of the engine 110. The temperature signal may be equal to a temperature indicated by the ECT signal from the ECT sensor 118 or may be offset from the temperature from the ECT signal.

Although shown separately in FIG. 3 for purposes of illustration only, the block heater protection module 304 may be implemented in the engine control module 302. The block heater correction module 304 and the engine control module 302 both receive the ECT signal from the ECT sensor 118 and the intake air temperature (IAT) signal from the IAT sensor 116. The IAT sensor 116 may be installed in the intake manifold 112 or another component of an intake system of the engine 110. For example, the IAT sensor 116 may be co-located with a mass air flow sensor.

The engine control module 302 controls a fuel system 310 to provide a desired fuel mass to each cylinder of the engine 110. The fuel system 310 may also control the timing of fuel injection. The fuel system 310 may adjust the desired fuel mass as well as the fuel injection timing based on the engine temperature. The engine control module 302 may control an ignition system 312 to generate a spark at a predetermined time in each cylinder of the engine 110. The ignition system 312 may be omitted in a diesel engine.

The engine control module 302 provides an engine operation signal to the block heater correction module 304. The engine operation signal may indicate whether the engine is running. When the engine operation signal indicates that the engine 110 is not running, the block heater correction module 304 may simulate the temperature of the engine 110, starting with the value of the ECT signal prior to engine shutdown.

The engine control module 302 may also provide an engine crank signal to the block heater correction module 304. The engine crank signal may be asserted while the engine 110 is cranking on start-up. Alternatively, the engine crank signal may include an indication of how long the engine cranked before starting. If the engine 110 did not start, the engine crank signal may report the entire cranking time.

The block heater correction module 304 may adjust its determination of whether the block heater was used based on the engine crank signal. For example, a long crank time may indicate that insufficient fuel is being provided to the cylinders. This may occur when the ECT signal is artificially high as a result of block heater usage. The block heater correction module 304 may then modify the temperature signal provided to the engine control module 302 to indicate a more accurate temperature of the engine 110 assuming that the block heater 122 is used.

The engine control module 302 may also provide a sensor fault signal to the block heater correction module 304. When the sensor fault signal indicates that a fault has been detected in the ECT sensor 118, the block heater correction module 304 may output a simulated engine temperature as the temperature signal to the engine control module 302.

Figure 4:
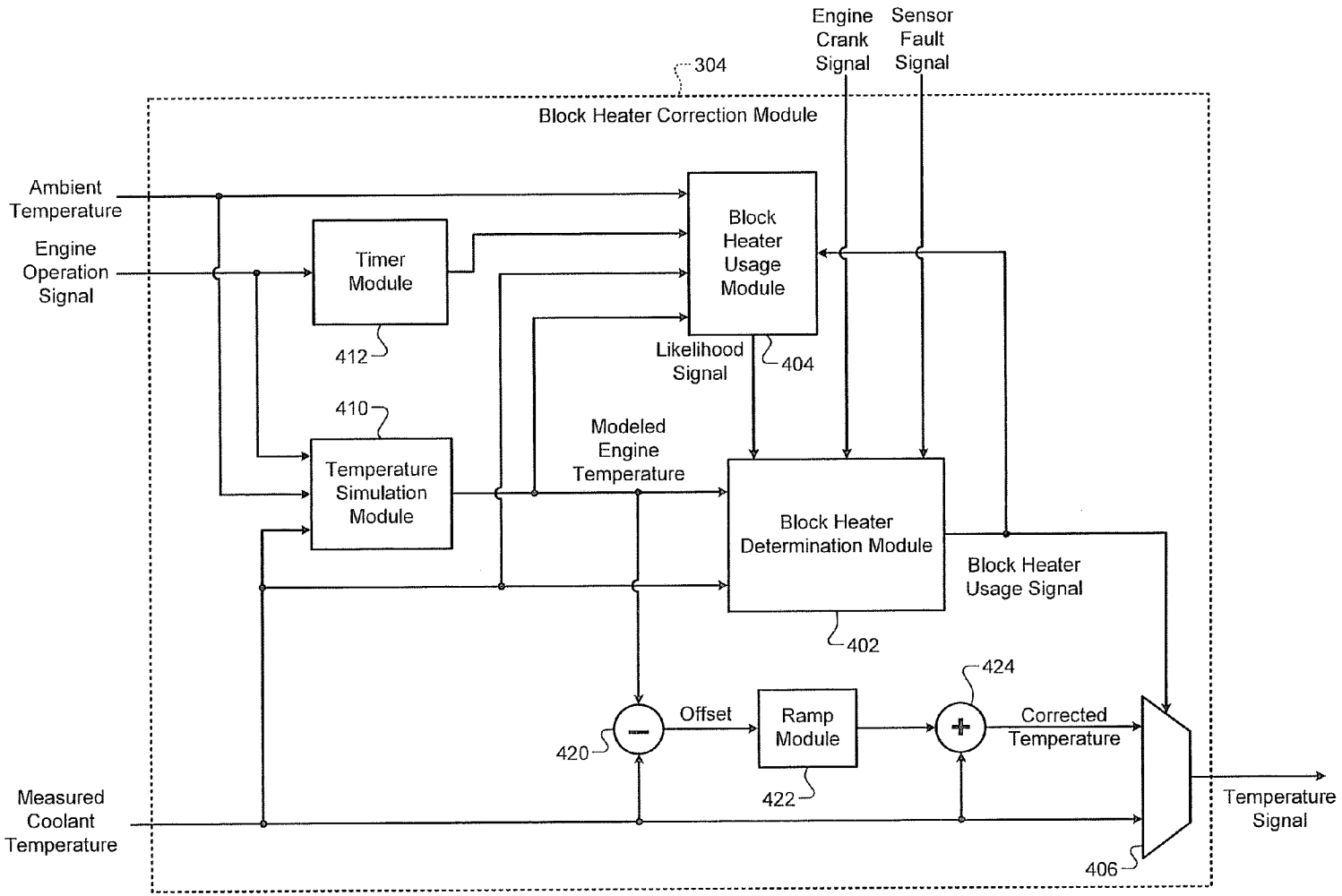
FIG. 4 is a functional block diagram of an exemplary block heater correction module according to the principles of the present disclosure.

Referring now to FIG. 4, a functional block diagram of an exemplary implementation of a block heater correction module 304 is shown. A block heater determination module 402 determines whether the block heater 122 has been used prior to the engine starting. The block heater determination module 402 generates a block heater usage signal indicating whether the block heater 122 has been used.

The block heater usage signal may be used to update historical usage information in a block heater usage module 404. The block heater usage signal may also select one of two inputs to a multiplexer 406 for output as the temperature signal. The multiplexer 406 may receive a coolant temperature at one input. For example only, the coolant temperature may be the ECT signal from the ECT sensor 118. A second input of the multiplexer 406 may be a corrected temperature.

A temperature simulation module 410 may simulate engine temperature during the time when the engine 110 is off. For example only, the temperature simulation module 410 may operate periodically while the engine 110 is off. Alternatively, the temperature simulation module 410 may perform a simulation prior to starting of the engine 110 that encompasses the time when the engine 110 was off.

If the temperature simulation module 410 periodically runs while the engine 110 is off, the temperature simulation module 410 may use updated ambient temperatures. If the temperature simulation module 410 executes prior to engine start-up, the temperature simulation module 410 may assume that the current ambient temperature has remained unchanged over the period that the engine 110 was off.

Alternatively, the ambient temperature may be stored at periodic intervals to increase the accuracy of a simulation performed by the temperature simulation module 410 prior to engine start-up. If the temperature simulation module 410 does not acquire temperature data periodically, the estimate upon start-up may be inaccurate. For example, the accuracy may decrease if the vehicle is moved into or out of a garage, or if the block heater is used during a period of time other than at the end of the engine off period.

A timer module 412 may track the amount of time the engine 110 has been off based on the engine operation signal. This engine off time is provided to the block heater usage module 404. The temperature simulation module 410 may also receive the engine off time, such as when the temperature simulation module 410 runs just prior to engine start-up.

The block heater usage module 404 may receive coolant temperature, ambient temperature, modeled engine temperature, and the length of time the engine 110 has been off prior to engine startup. The block heater usage module 404 determines the likelihood that the block heater 122 was used and outputs a likelihood signal to the block heater determination module 402.

The ambient temperature may be determined from the IAT signal and/or may be determined from an engine oil temperature. For example only, the engine oil temperature may be measured in an engine oil pan, which has a large surface exposed to the outside air. Therefore, while the engine oil temperature does not immediately track the ambient temperature, the engine oil temperature may serve as an adequate estimation of ambient air temperature while the engine is turned off.

The block heater usage module 404 may supplement its stored historical data based on the block heater usage signal. For example only, the block heater usage module 404 may include a look-up table that tracks engine start events based on operating conditions such as ambient temperature, coolant temperature, modeled engine temperature, and engine off time. For example only, each look-up table entry may correspond to a specified range of ambient temperatures and to a specified range of engine off times.

Within each look-up table entry, the block heater usage module 404 may store two values. A first value indicates the number of times the engine has been started in those operating conditions, and a second value indicates the number of times a block heater has been used prior to engine start-up for these operating conditions. The block heater usage module 404 may increment a corresponding one of the look-up table entries each time the engine is started. When the block heater determination module 402 determines that the block heater 122 had been used prior to engine start-up, the block heater usage module 404 may increment the second value in the corresponding look-up table entry.

The likelihood signal may indicate a percentage equal to the second value divided by the first value. Alternatively, the likelihood signal may have two states: a first state indicating that the block heater 122 was likely used, and a second state indicating that the block heater 122 was likely not used. For example only, the block heater usage module 404 may output the likelihood signal having a first state, when the second value divided by the first value is greater than a predetermined threshold. For example only, the predetermined threshold may be 50 percent.

The block heater determination module 402 outputs the block heater usage signal based on the modeled engine temperature, the coolant temperature, the likelihood signal, the engine crank signal, and a sensor fault signal. A subtraction module 420 may subtract the coolant temperature from the modeled engine temperature to create an offset. The offset may be negative when the coolant temperature is greater than the modeled temperature because of the localized heating effect of the block heater 122.

A ramp module 422 receives the offset and provides an adjusted offset to a summation module 424. The summation module 424 adds the adjusted offset to the coolant temperature to generate the corrected temperature. When the offset is negative, the corrected temperature will be less than the coolant temperature.

The ramp module 422 decreases the absolute value of the offset over time. In other words, the ramp module 422 makes the adjusted offset closer and closer to zero over time. This reflects the fact that the coolant temperature will become an accurate representation of engine temperature when the engine 110 is on and the coolant is circulating. The ramp module 422 may generate the adjusted offset by applying a ramp to the offset signal, such as a linear or logarithmic ramp. Once the adjusted offset reaches zero, the corrected temperature will be approximately equal to the coolant temperature.

Figure 5:
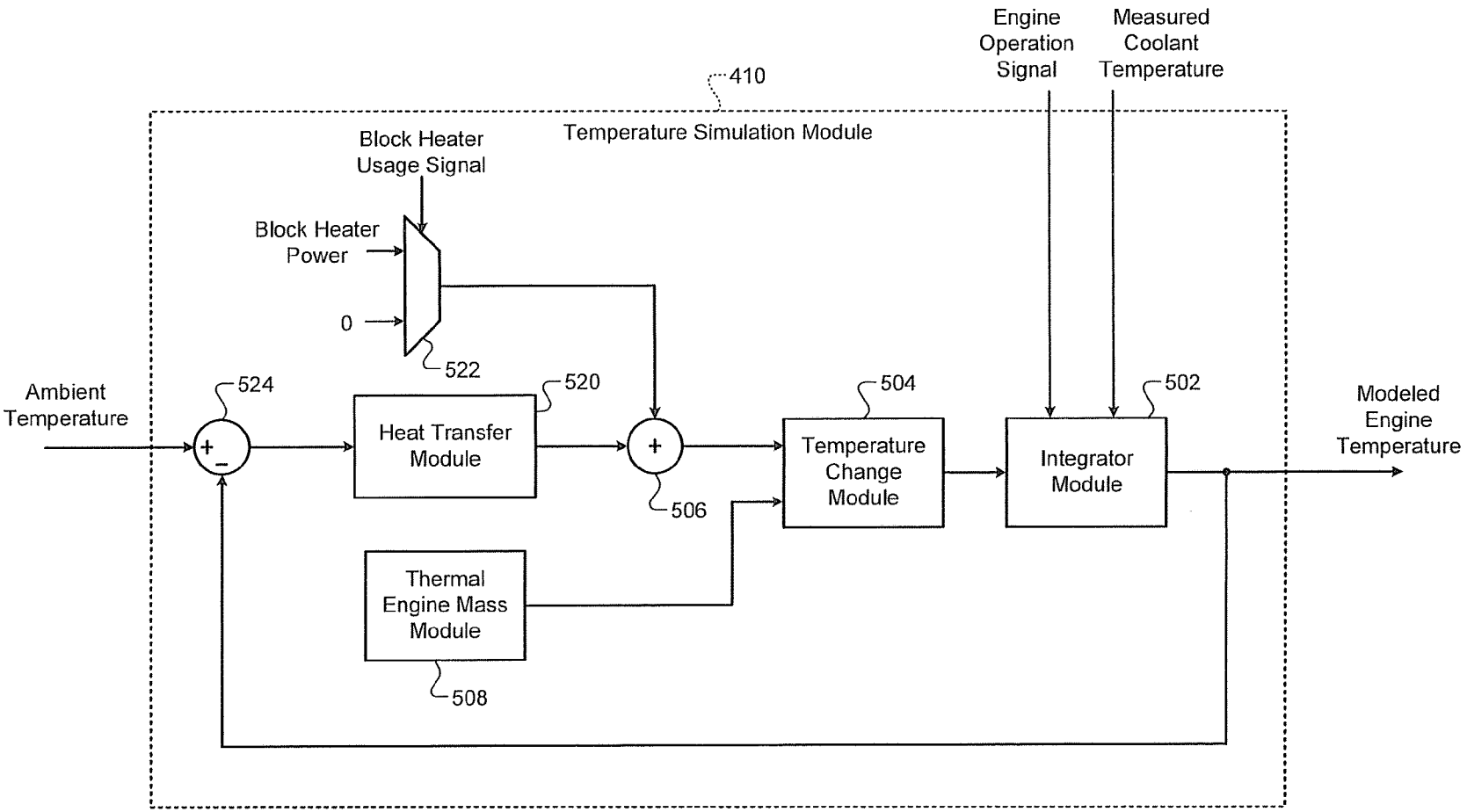
FIG. 5 is a functional block diagram of an exemplary temperature simulation module according to the principles of the present disclosure.

Referring now to FIG. 5, a functional block diagram of an exemplary implementation of the temperature simulation module 410 is presented. An integrator module 502 outputs the modeled engine temperature. The integrator module 502 may be initialized at engine shutdown to the current engine temperature. For example only, the integrator module 502 may receive an engine operation signal. When the engine operation signal indicates that the engine is shutting down or has shut off, the integrator module 502 may initialize to the current coolant temperature.

The integrator module 502 integrates temperature changes received from a temperature change module 504. The temperature change module 504 may receive a heat transfer value from a summation module 506 and a thermal mass value from a thermal engine mass module 508. For example only, the summation module 506 may output a heat transfer value in Watts to the temperature change module 504.

The thermal engine mass module 508 may calculate the thermal mass value based on a predetermined specific heat of the engine in Joules/(gram-Kelvin) multiplied by a mass of the engine in grams. The summation module 506 receives a first heat transfer value from a heat transfer module 520 and a second heat transfer value from a multiplexer 522.

The heat transfer module 520 may generate the first heat transfer value based on a predetermined heat transfer constant in Watts/° C. times a temperature differential between the engine and outside air. The temperature differential may be obtained from a subtraction module 524. The subtraction module 524 may subtract the modeled engine temperature from the ambient temperature. When the ambient temperature is less than the modeled engine temperature, the first heat transfer value will be negative.

The multiplexer 522 outputs the second heat transfer value based on an assumed contribution from the block heater 122. When the block heater is determined to be off, the multiplexer 522 outputs a value of zero. When the block heater is determined to be on, the multiplexer 522 outputs a predetermined block heater power in Watts. A block heater usage signal determines which input the multiplexer 522 will select. The block heater usage signal may be received from the block heater determination module 402.

Alternatively, the block heater usage signal may be generated based on a differential between the modeled engine temperature and the coolant temperature. For example, if the coolant temperature is greater than the modeled engine temperature by more than a predetermined threshold, the block heater 122 may be assumed to be on, and the multiplexer 522 outputs the block heater power. The temperature change module 504 may divide the combined heat transfer value from the summation module 506 by the thermal mass value from the thermal engine mass module 508. The resulting value, in units of temperature, is output to the integrator module 502.

Figure 6:
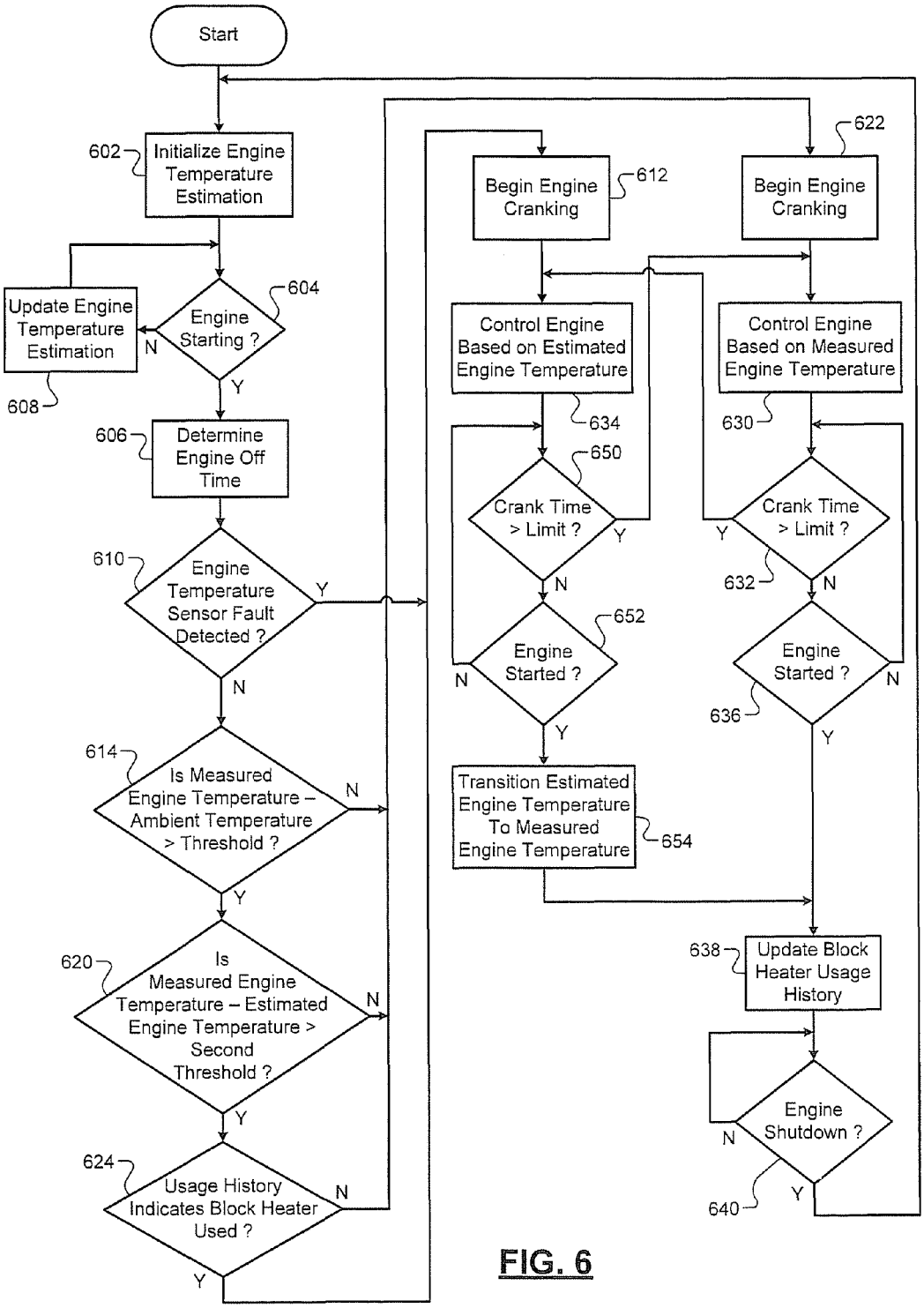
FIG. 6 is a flowchart depicting exemplary steps performed by the engine system of FIG. 3 according to the principles of the present disclosure.

Referring now to FIG. 6, a flowchart depicts exemplary steps performed by the engine system of FIG. 3 according to the principles of the present disclosure. Control begins in step 602, where control initializes engine temperature estimation. For example, an integration operation may be initialized to the current engine coolant temperature, which is assumed to be an accurate representation of engine temperature. Control continues in step 604, where the engine is starting, control transfers to step 606; otherwise, control transfers to step 608. In step 608, control updates the engine temperature estimation based on current ambient temperature and returns to step 604.

In step 606, control determines engine off time, such as by reading a value from a timer. The timer may be reset in step 602 when the engine temperature estimation is initialized. Control continues in step 610, where control determines whether a fault has been detected with the engine temperature sensor. If so, control transfers to step 612; otherwise, control transfers to step 614. The engine temperature sensor may include the ECT sensor 118.

In step 614, control determines whether measured engine temperature minus ambient temperature is greater than a threshold. If so, control transfers to step 620; otherwise, control transfers to step 622. Measured engine temperature may be based on the ECT signal from the ECT sensor 118. Ambient temperature may be based on the IAT signal from the IAT sensor 116 or on an engine oil temperature signal. Step 612 corresponds to detection of block heater usage, while step 622 corresponds to detection of no block heater usage. If the measured engine temperature is close to the ambient temperature (a difference being less than a threshold), the block heater 122 has not significantly increased the measured engine temperature. The measured engine temperature can therefore be used for engine control.

In step 620, control determines whether the measured engine temperature minus the estimated engine temperature is greater than a second threshold. If so, control transfers to step 624; otherwise, control transfers to step 622. The second threshold may be equal to the threshold of step 614 or may be different.

In step 624, control determines whether the usage history corresponding to the current operating conditions indicates that the block heater has been used. The operating conditions may include the current ambient temperature, the modeled engine temperature, the coolant temperature, and the length of time the engine 110 has been off prior to engine startup. If usage history indicates that the block heater is likely to have been used, control transfers to step 612; otherwise, control transfers to step 622.

In step 622, control begins engine cranking to start the engine 110. Control continues in step 630, where the engine is controlled based on measured engine temperature. For example only, a desired air/fuel ratio and a desired spark advance are determined based on measured engine temperature. In step 632, control determines whether crank time is greater than a limit. If so, the determination that the block heater was not used may be erroneous, and control transfers to step 634; otherwise, control transfers to step 636.

In step 636, control determines whether the engine is started. If so, control transfers to step 638; otherwise, control returns to step 632. In step 638, control updates block heater usage history. When control arrives at step 638 from step 636, the block heater usage history is updated to indicate that a block heater was not used for the most recent engine start. Control continues in step 640, where control remains until the engine shuts down. When the engine shuts down, control returns to step 602.

In step 612, control begins engine cranking to start the engine 110. Control continues in step 634, where the engine is controlled based on estimated engine temperature. Control continues in step 650, where control determines whether the crank time is greater than the limit. For example only, the limit of step 650 may be equal to the limit of step 632. When the crank time is greater than the limit, control determines that the identification of block heater usage may have been erroneous and control transfers to step 630. Otherwise, control transfers to step 652.

In step 652, if the engine has started, control transfers to step 654; otherwise, control returns to step 650. In step 654, control transitions the estimated engine temperature to the measured engine temperature over time. For example, control may reduce an offset between the estimated engine temperature and the measured engine temperature. This offset may be reduced linearly or logrithmically. Control then continues in step 638. When control arrives in step 638 from step 634, control updates the block heater usage history to indicate that the block heater was used in the most recent engine start.

Figure 7:
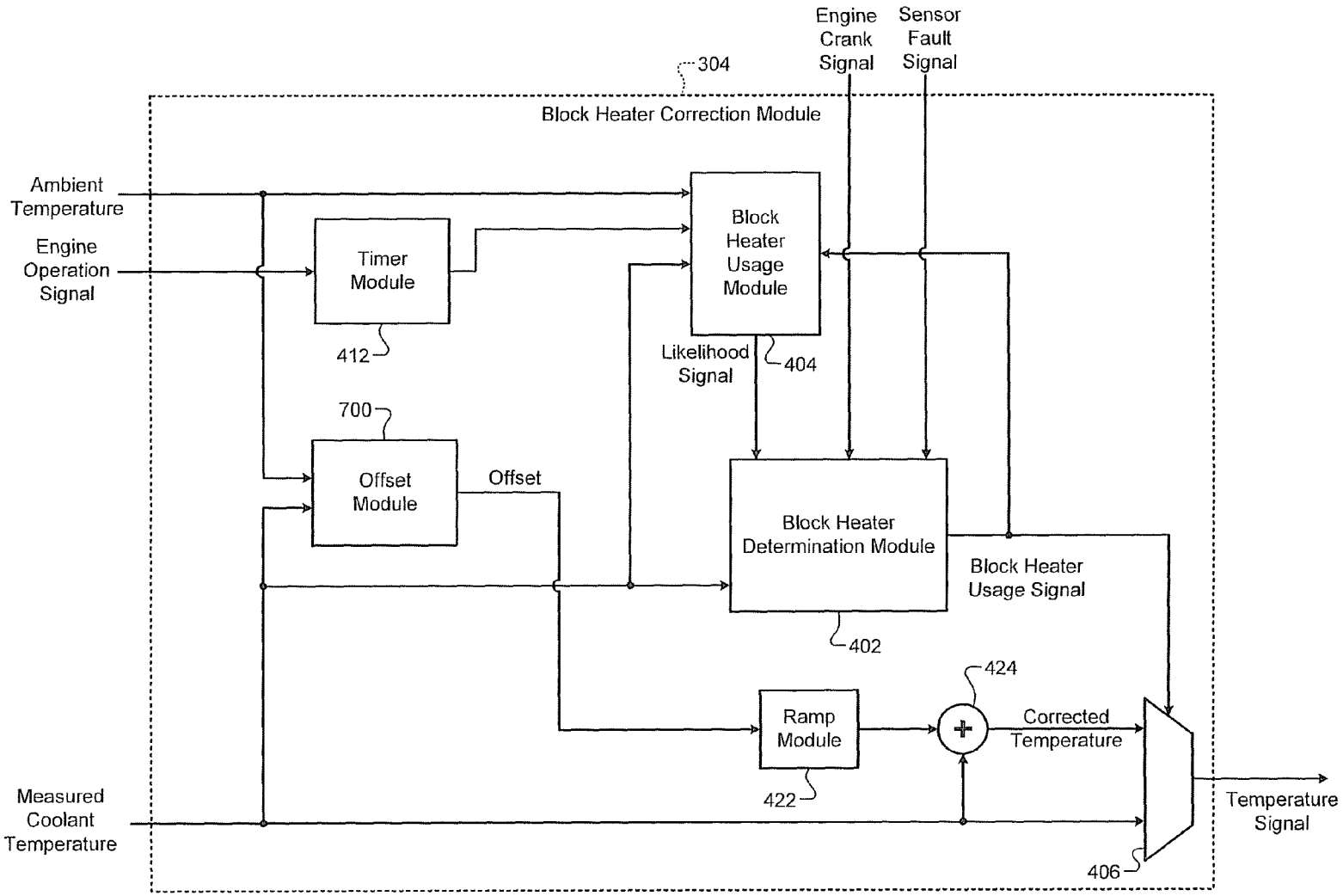
FIG. 7 is a functional block diagram of another exemplary block heater correction module according to the principles of the present disclosure.

Referring now to FIG. 7, a functional block diagram of another exemplary implementation of the block heater correction module 304 is presented. The block heater correction module 304 of FIG. 7 may include similar components as the block heater correction module 304 of FIG. 4. An offset module 700 determines an offset based on the ambient temperature and the coolant temperature. This offset is outputted to the ramp module 422.

The offset module 700 may calculate a difference between the ambient temperature and the coolant temperature, and use the difference to index a look-up table. The look-up table may store offsets as a function of the temperature difference. Generating this offset may require less computational power than using a temperature model, such as is shown in FIG. 4.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system for an engine, comprising:

a block heater determination module that generates a block heater usage signal based on ambient temperature, measured engine coolant temperature, and a length of time of the engine being off prior to engine startup;

an adjustment module that generates a temperature signal based on the ambient temperature; and an engine control module that determines a desired fuel mass for fuel injection at engine startup based on the temperature signal when the block heater usage signal has a first state and that determines the desired fuel mass at engine startup based on the measured engine coolant temperature when the block heater usage signal has a second state.

2. The control system of claim 1 wherein the engine control module controls fuel injection timing at engine startup based on the temperature signal when the block heater usage signal has the first state and controls fuel injection timing at engine startup based on the measured engine coolant temperature when the block heater usage signal has the second state.

3. The control system of claim 1 wherein the block heater determination module generates the block heater usage signal having the second state when the measured engine coolant temperature minus the ambient temperature is less than a threshold.

4. The control system of claim 1 wherein the ambient temperature is received from an intake air temperature sensor, wherein the measured engine coolant temperature is received from an engine coolant temperature sensor, and wherein the block heater determination module generates the block heater usage signal having the first state when a fault is detected in the engine coolant temperature sensor.

5. The control system of claim 1 wherein the block heater determination module generates the block heater usage signal having the first state when a crank time of the engine is greater than a threshold after generating the block heater usage signal having the second state.

6. The control system of claim 1 further comprising a block heater usage module that generates a usage likelihood signal based on previous determinations of block heater usage.

7. The control system of claim 6 wherein the block heater usage module stores previous determinations of block heater usage for each of non-overlapping ranges of operating conditions, wherein the operating conditions include at least one of ambient temperature and the length of time of the engine being off prior to engine startup.

8. The control system of claim 1 wherein the adjustment module generates the temperature signal based on a sum of the measured engine coolant temperature and an offset.

9. The control system of claim 8 wherein the offset is determined from a lookup table that is indexed by a difference between the measured engine coolant temperature and the ambient temperature.

10. The control system of claim 8 wherein the offset is ramped to approximately zero after the engine is started.

11. The control system of claim 1 wherein the temperature signal is based on a first order heat transfer model of the engine.

12. A method of controlling an engine, comprising:

generating a block heater usage signal based on ambient temperature, measured engine coolant temperature, and a length of time of an engine being off prior to engine startup;

generating a temperature signal based on the ambient temperature;

determining a desired fuel mass for fuel injection at engine startup based on the temperature signal when the block heater usage signal has a first state; and determining the desired fuel mass at engine startup based on the measured engine coolant temperature when the block heater usage signal has a second state.

13. The method of claim 12 further comprising controlling fuel injection timing at engine startup based on the temperature signal when the block heater usage signal has the first state and controlling fuel injection timing at engine startup based on the measured engine coolant temperature when the block heater usage signal has the second state.

14. The method of claim 12 further comprising generating the block heater usage signal having the second state when the measured engine coolant temperature minus the ambient temperature is less than a threshold.

15. The method of claim 12 further comprising:

receiving the ambient temperature from an intake air temperature sensor;

receiving the measured engine coolant temperature from an engine coolant temperature sensor; and generating the block heater usage signal having the first state when a fault is detected in the engine coolant temperature sensor.

16. The method of claim 12 further comprising, after generating the block heater usage signal having the second state, generating the block heater usage signal having the first state when a crank time of the engine is greater than a threshold.

17. The method of claim 12 further comprising generating a usage likelihood signal based on previous determinations of block heater usage.

18. The method of claim 17 further comprising storing previous determinations of block heater usage for each of non-overlapping ranges of operating conditions, wherein the operating conditions include at least one of ambient temperature and the length of time of the engine being off prior to engine startup.

19. The method of claim 12 further comprising generating the temperature signal based on a sum of the measured engine coolant temperature and an offset.

20. The method of claim 19 further comprising determining the offset from a lookup table that is indexed by a difference between the measured engine coolant temperature and the ambient temperature.

21. The method of claim 19 further comprising ramping the offset to approximately zero after the engine is started.

22. The method of claim 12 further comprising determining the temperature signal based on a first order heat transfer model of the engine.

* * * * *